US008051986B2

(12) United States Patent
Lees

(10) Patent No.: US 8,051,986 B2
(45) Date of Patent: Nov. 8, 2011

(54) BIOMASS MATERIAL

(75) Inventor: Tony Lees, Adlington (GB)

(73) Assignee: Orchid LP Limited, Adlington, Lancashire (GB)

( * ) Notice: Subject to any disclaimer, the term of this patent is extended or adjusted under 35 U.S.C. 154(b) by 614 days.

(21) Appl. No.: 11/569,744

(22) PCT Filed: May 26, 2005

(86) PCT No.: PCT/GB2005/002090

§ 371 (c)(1),
(2), (4) Date: Nov. 28, 2006

(87) PCT Pub. No.: WO2005/118165

PCT Pub. Date: Dec. 15, 2005

(65) Prior Publication Data

US 2007/0209974 A1 Sep. 13, 2007

(30) Foreign Application Priority Data

May 29, 2004 (GB) ..... 0412216.4
Mar. 16, 2005 (GB) ..... 0505323.6

(51) Int. Cl.
*B07B 4/00* (2006.01)

(52) U.S. Cl. ..... 209/139.1; 209/138; 209/147; 209/154; 209/925; 209/930

(58) Field of Classification Search ..... 209/21, 209/138, 139.1, 142, 143, 146, 147, 154, 209/925, 930

See application file for complete search history.

(56) References Cited

U.S. PATENT DOCUMENTS

| | | | | |
|---|---|---|---|---|
| 3,904,515 | A * | 9/1975 | MacKenzie et al. | 209/3 |
| 4,010,097 | A * | 3/1977 | Murray et al. | 209/139.1 |
| 4,288,318 | A * | 9/1981 | Essmann et al. | 209/139.1 |
| 4,528,092 | A * | 7/1985 | Krambrock et al. | 209/139.1 |
| 4,931,173 | A * | 6/1990 | Lesher | 209/138 |
| 5,152,604 | A * | 10/1992 | Paul | 366/101 |
| 6,694,900 | B2 * | 2/2004 | Lissianski et al. | 110/345 |
| 2005/0126957 | A1 * | 6/2005 | Porter et al. | 209/11 |

FOREIGN PATENT DOCUMENTS

EP 0093220 11/1983

* cited by examiner

*Primary Examiner* — Joseph C Rodriguez
(74) *Attorney, Agent, or Firm* — Quarles & Brady LLP; Gavin J. Milczarek-Desai

(57) ABSTRACT

A process for the production of a range of improved biomass material products suitable for use as a fuel and which have been derived from municipal solid waste (MSW). The process comprises the steps of delivering a stream of mixed, MSW derived biomass material into a separator which operates under negative pressure enabling the biomass material to fall down the separator while inducing a sole air stream through the falling material to create a vortex of spinning material within the turbo chamber to separate out by centrifugal action selected denser components of the biomass material enabling such to continue falling to an outlet for collection while redirecting by entrainment in the air stream the remaining biomass material to a second outlet for subsequent processing or for collection.

23 Claims, 3 Drawing Sheets

BIOMASS MATERIAL

BACKGROUND OF THE INVENTION

The present invention relates to a process for the production of a range of improved biomass material products, and in particular to the improvement of a biomass material which has been formed as a bi-product from the treatment of municipal solid waste (MSW). The invention further relates to an apparatus for the production of such range of improved biomass material products and the range of biomass materials produced thereby. The biomass material products produced are particularly suitable for use as a fuel for power generation, gasification, hospitals, industrial heating and domestic heating. The biomass materials products produced are suitable as an alternative fuel to fossil fuels, or standard biomass fuels formed from for example shredded dried wood and/or grass.

Incineration is a previously known method for the disposal of MSW. MSW generally comprises a combination of waste materials such as paper, vegetation, food, rubbers, textiles, wood, leather, plastics, glass and metals, or could contain waste from commercial outlets for example fast-food restaurants having a substantial mix of food, plastics and paper. Combustion of the MSW produces a heat energy which, for example, can be used to produce electricity. However, burning produces ash and noxious fumes which must be contained and further processed to enable their safe disposal.

Many governments now place restrictions on the burning of fuels in order to strictly limit the amount of noxious substances released into the environment. It is therefore desirable to process the MSW in a manner which enables the separation and recovery of inorganic and organic material therefrom. The separated organic material after further processing can then be used as a fuel which can be burnt in an environmentally more friendly manner.

Traditionally it is known to separate the organic and inorganic matters by saturating the MSW with water and/or steam, whilst heating and rotating the MSW to cause pulping of the organic material therein. The treated organic matter is then separated from the inorganic components of the waste by allowing it to fall through a screen. Examples of such processes are described in U.S. Pat. Nos. 5,190,226 and 5,556,445. However, these known processes provide a pulped organic matter with a water content of between 35% to 70%, which is extremely wet and therefore further processing is required to reduce the water content to render the pulp suitable for use as a compost or fuel. Also, the pulped material will still contain some non-combustible material such as metals, rubble, glass etc, and combustible toxic materials such as plastics and rubbers which are of a size which has enabled their passage through the perforations of the screen with the thus recovered organic matter. The presence of such non-combustible material and toxic materials reduces the value of the biomass fuel produced from the recovered organic material, since burning of such fuel still results in the production of some noxious gas and ash, lowering its potential energy density.

International Patent Application No. WO 03/092922 describes an improved method for the treatment of MSW which provides an organic pulped material having a moisture content of up to 15% which is highly suitable for further processing to produce a fuel or compost. However, the improved organic pulped material is still separated from the non-organic components of the waste by its passage through a trommel screen, and thus still contains some non-organic and toxic components.

Air separators are known which use two flows of air to separate out material based on its density. One such system is known from EP 0982082 (Beloit Technologies Inc). In this prior system air is drawn through a vertical separation chamber which is open to the atmosphere. Material to be separated is introduced into the rising stream of air and material having a lower density rises with the uprising air, whilst heavier material falls through the open bottom of the separator. The dispersion of the material is accomplished with a jet of high pressure air which breaks up and disperses the material within the rising air stream. This system is particularly adapted to separate wood chips, with the more dense knotted chips falling through the uprising current of air and, with the lighter chips being drawn up the separation chamber. However, this system is unsuitable for separating MSW. This is because MSW contains items such as glass shards, which although possessing a relatively high density also have a relatively large cross-sectional area which would enable them to be captured by the high pressure jet and forced up the separation chamber, rather than falling down to the outlet for collection.

BRIEF SUMMARY OF THE INVENTION

It is an object of the present invention to provide a method of processing organic pulped material separated from the MSW during its treatment which produces at least one high quality biomass material containing less non-organic and toxic contaminants and which has when burnt improved noxious emissions, a much reduced ash content, whilst maintaining a good calorific value.

In accordance with a first aspect of the present invention there is provided a process for the treatment of municipal solid waste (MSW) derived biomass material to reduce the level of contaminants therein comprising the steps of:

delivering a stream of mixed, MSW derived biomass material to a first inlet of a vacuum turbo separator operating under negative pressure;

enabling said delivered biomass material to fall as a curtain of material from said first inlet through a turbo chamber to a first outlet of the separator;

inducing a sole air stream to flow from a second inlet of the separator through the turbo chamber to a second outlet of the separator;

directing said air stream through said falling material in the turbo chamber to entrain said material therein and to induce a vortex of spinning biomass material within the turbo chamber to separate out by centrifugal action denser components of the biomass material;

continuing said falling of said separated denser biomass material to said first outlet for collection in a receiving bay; and redirecting said remaining entrained biomass material to said second outlet in said air stream.

The step of inducing said air stream may include the step of inducing at a low velocity. The step of redirecting the remaining entrained biomass material in said air stream may include the step of accelerating the air stream in said turbo chamber.

The process may comprise the step of air washing said separated denser biomass material with said air stream down stream of said vortex to separate out lighter components of the biomass material therein, and redirecting said separated out lighter components to said second outlet via the air stream.

The step of inducing an air stream may include drawing air though the separator and said step of directing includes directing the air stream in substantially the opposite direction to the falling curtain of material.

The curtain of falling biomass material and/or the flow of induced air may be adjusted to select the density of components separated from the biomass material.

In accordance with a second aspect of the present invention there is provided a process for the treatment of municipal solid waste (MSW) derived biomass material to reduce the level of contaminants therein comprising the steps of:

delivering a stream of mixed, MSW derived biomass material into a positive pressure density separator, directing an air stream through the biomass material in the density separator to entrain selected lighter components therein and to move such lighter components a first outlet of the density separator, and collecting the remaining biomass material and sending it to a second outlet of the density separator for collection in a receiving bay.

The air stream may be directed obliquely at said redirected biomass material. In a further embodiment the step of conveying is by a positive pressure air conveying steam.

The process may further comprise the step of distributing and separating components of the biomass material within the conveying air stream.

The separated lighter components may be plastics and may be further separated into various component parts by adjusting the temperature and/or airflow in the density separator.

The process may include the step of separating dust from the separated lighter components in a cyclone separator.

The process may include the step of directing said separated dust to a dust filter.

The process may comprise the step of directing said lighter components from the cyclone to a receiving bay and/or to the or a positive pressure density separator.

The mixed MSW derived biomass material may be sieved to remove components therein having a dimension greater than 50 mm, more preferably 10 mm, most preferably 3 mm before the step of delivering.

In accordance with a third aspect of the present invention there is provided an apparatus for the treatment of municipal solid waste (MSW) derived biomass material to reduce the level of contaminants therein, comprising a vacuum turbo separator having at least one inlet and two outlets, said inlet being adapted to admit a stream of mixed, MSW derived biomass material, at least one material duct enabling said biomass mass material to fall as a curtain of material from said inlet to a first of the outlets for collection in a receiving bay, a turbo chamber in said material duct, means to supply a sole current of air and to direct it through the falling curtain of biomass material in the turbo chamber for redirecting selected lighter components of the biomass material in the air stream to the second of said outlets, and means to maintain said material duct under negative pressure.

The air supply means may direct air at least partially through said material duct downstream of said turbo chamber.

The means to maintain said material duct under negative pressure may include at least one air lock at said inlet and/or first outlet.

The means to maintain said material duct under negative pressure may include induction means to draw said air stream though the turbo separator.

The apparatus may comprise means to adjust the geometry of at least one of the material duct, the turbo chamber, and an exit from the turbo chamber for said redirected lighter components to the second outlet.

In accordance with a fourth aspect of the present invention there is provided an apparatus for the treatment of municipal solid waste (MSW) derived biomass material to reduce the level of contaminants therein comprising a positive pressure density separator having at least one inlet and two outlets, the inlet being adapted to admit a stream of mixed, MSW derived biomass material, at least one duct to direct the biomass material through a first of the outlets, and means to supply a current of air and direct it through the stream of biomass material to separate out selected lighter components therein and to direct such to a second of the outlets.

The apparatus may comprise a positive pressure air conveying system to direct the biomass material through the density separator and the separator may comprise at least one adjustable channel to respectively change the direction of flow of the biomass material stream. The separator may comprise means for directing the airflow at the stream of mixed, MSW derived biomass material as it changes direction.

The apparatus may comprise a second inlet for admitting said current of air, and at least one air duct for directing the current of air obliquely at the stream of mixed, MSW derived biomass material.

The density separator may comprise a distribution chamber upstream of the adjustable channel and may comprise means to direct the air flow through the remaining stream of biomass material downstream of said adjustable channel. The density separator may be provided downstream of said second outlet of said turbo separator.

At least one fan may be provided for providing a positive pressure conveying system for transferring mixed MSW biomass material though the positive pressure density separator. At least one cyclone may be provided having an air inlet connected to the second outlet of the vacuum separator or density separator and at least two cyclone outlets, a first of which cyclone outlets being connection to at least one of the positive pressure density separator and/or collection bay for collection of the improved biomass material.

In accordance with the fifth aspect of the present invention there is provided an improved biomass material product as an end product of the process for reducing contaminants in the municipal solid waste (MSW) derived biomass material. The improved biomass material product may find particular application as a fuel and may have a gross calorific value of 13 to 16 kj/kg and/or may have a total moisture content of less than 17%, and/or ash content of less than 16% and/or a chlorine content of less than 0.3%. The process additionally yields a number of bi-products such as glass, rubble, plastics, and non-combustible material each of which can be recycled and/or further processed to form a number of further products, or blended to provide a lower grade fuel.

BRIEF DESCRIPTION OF THE DRAWINGS

By way of example only specific embodiments of the present invention will now be described with reference to the accompanying drawings, in which.

DETAILED DESCRIPTION OF THE INVENTION

The starting point for the present process, in accordance with a first embodiment is the provision of a coarse mixed biomass waste material 2 produced as an end product of the treatment of municipal solid waste (MSW) and which comprises pulped organic material, and non-organic and toxic components having no dimension greater than 50 mm. A suitable biomass material of such high quality is produced as an end product by the method of treatment described in International Patent Application No. WO 03/092922.

Figure 1:
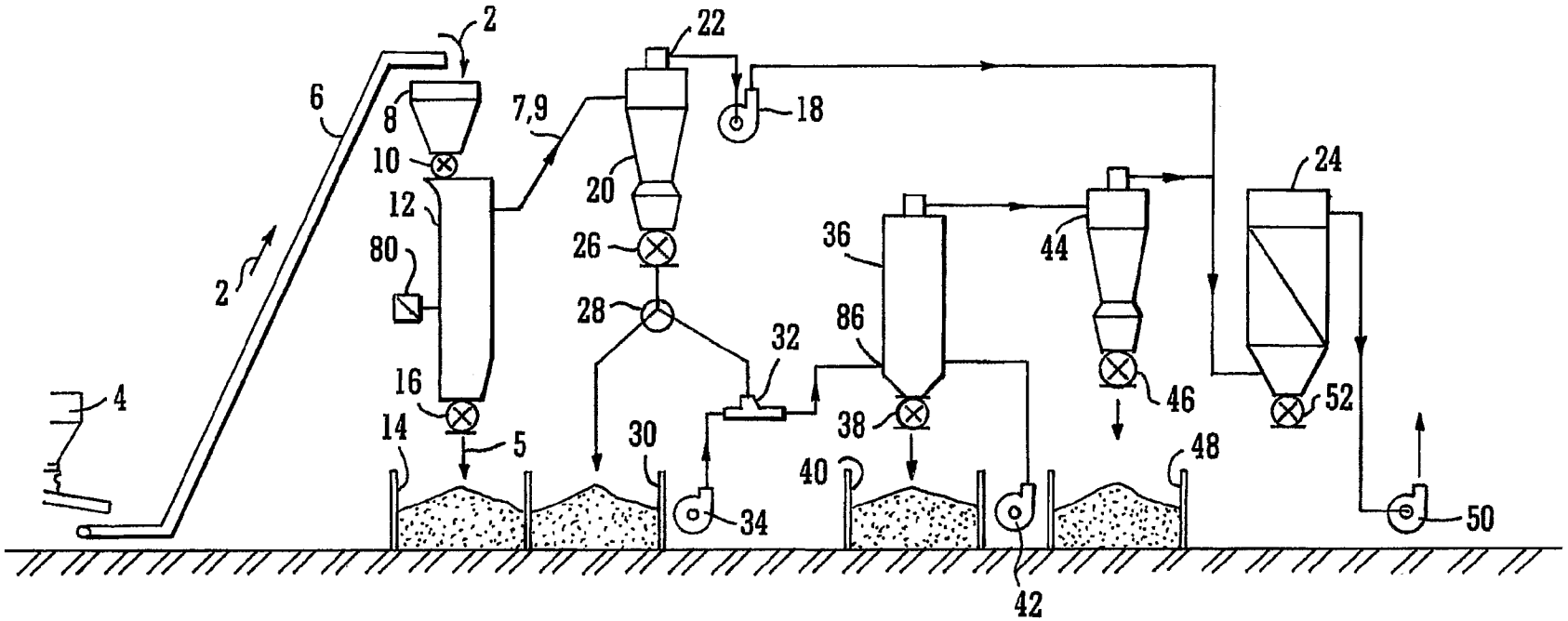
FIG. 1 is a schematic view of an apparatus for the production of an improved biomass material constructed in accordance with a first embodiment of the present invention.

Referring to FIG. 1 mixed biomass material 2 is fed into a storage hopper 4 for use in the process. From the hopper 4 the biomass material 2 is fed at a controlled rate and then transported via conveyors 6 into a feed hopper 8. From the feed hopper 8, via a rotary valve 10 at its outlet, the biomass material 2 is scavenge fed at a controlled rate into a vacuum turbo separator 12 (to be described in more detail further herein under). At this stage of the process the combustible material is separated from the heavier non-combustible material. The heavy non-combustible material thus separated from the mixed biomass material is discharged into a receiving bay 14 via a rotary valve 16. Induced air which is required for this process is provided by air fan 18.

The remaining mixed biomass material 2 is then conveyed by the air flow out of vacuum turbo separator 12 into a transfer cyclone 20. The vortex created therein separates dust from the mixed biomass material 2 and discharges it through outlet 22 from where it is conveyed to dust filter 24. The remaining mixed biomass material is discharged through outlet rotary valve 26 through a diverter valve 28 where it can be selectively sent to either receiving bay 30 or into entry junction 32 of a positive pressure conveying system, with propelling air being provided by conveying fan 34. The mixed biomass material is either collected or conveyed via the positive pressure conveying system into a positive pressure density separator 36 (to be described in more detail further herein under). The positive pressure density separator 36 is specifically designed to take out the larger pieces of plastics from the biomass combustible material allowing the remaining mixed biomass material, the resultant high quality biomass fuel product, to discharge through rotary valve 38 into a receiving bay 40. Secondary air required for this process is provided by fan 42. The removal of these heavy plastics reduces the chlorine content and other noxious emissions and thereby provides an environmentally friendly, high quality biomass fuel product.

The separated pieces of plastics are conveyed out of the density separator 36 into a high efficiency cyclone 44 in which the plastics are separated from the conveying air and are discharged via rotary valve 46 into a receiving bay 48. The removed air is then directed into the dust filter 24 which contains a fabric filter. The filtered air is emitted via exhaust fan 50, whilst the dust collected by the dust filter 24 is discharged via rotary valve 52 into a storage hopper (not illustrated) to feed to a tanker or for blending back into the fuel products.

Figures 2A, 2B:
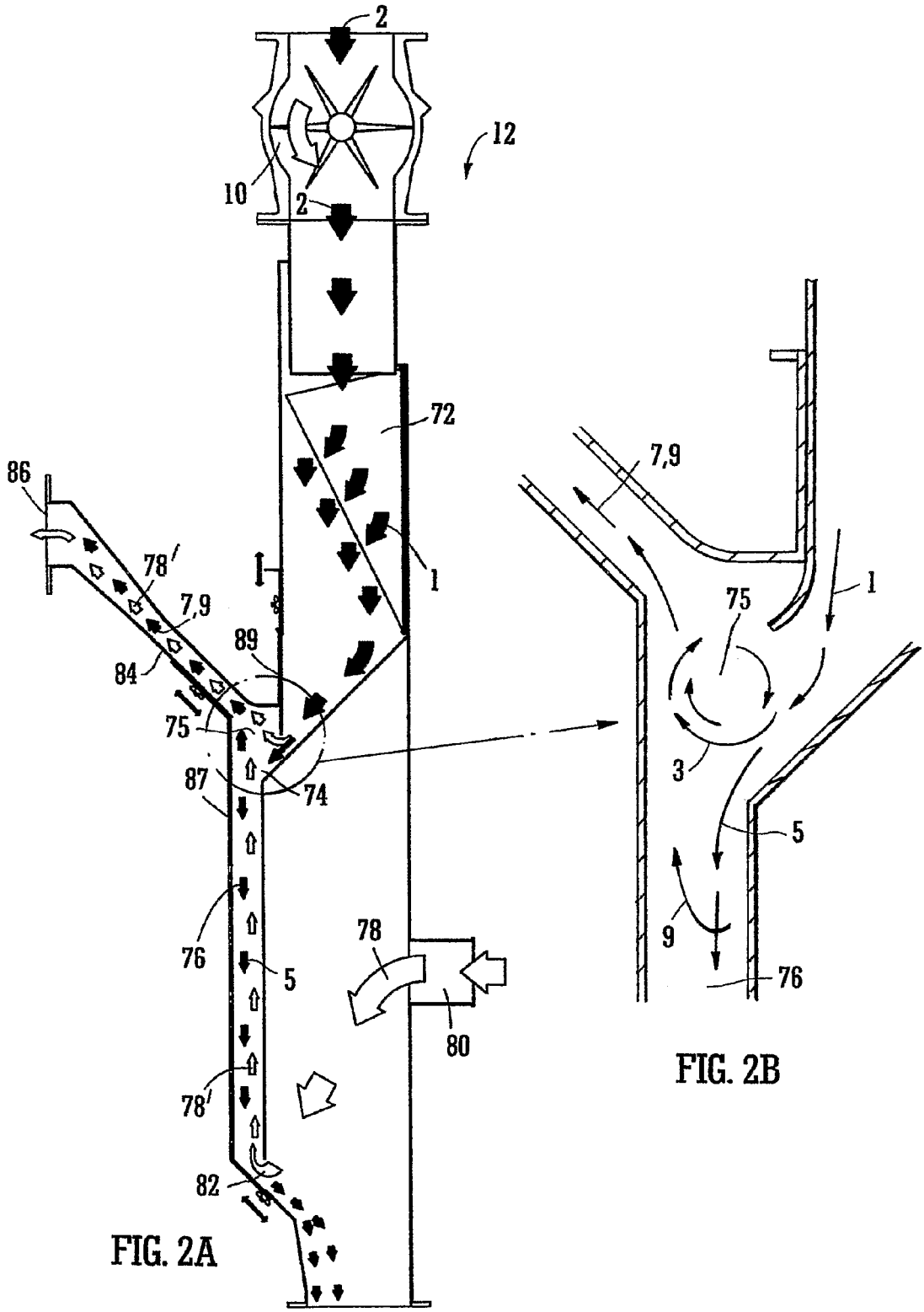
FIG. 2*a* is a sectional view of the vacuum turbo separator of FIG. 1.
FIG. 2*b* is an enlarged view of the turbo chamber of FIG. 2*a*.

In the vacuum turbo separator 12, as best illustrated in FIG. 2 the mixed biomass material 2 is fed at a controlled rate via a rotary airlock 10 onto an adjustable spreader plate 72. This converts a single stream of waste into a uniform wide band of material 1 that will fall as a continuous curtain of waste at junction 74 into a turbo/vortex chamber 75 and then into an air wash column 76.

The vacuum turbo separator 12 is operated under vacuum. A controlled amount of air 78 is drawn via fan 18 into the separator 12 though a series of adjustable air inlets 80, which may contain a filter, and are designed to allow a variable velocity profile to be created. The air 78 passes down into the inside of the separator 12 to junction 82, whereat it turns though 180° and then flows at a low velocity, in this embodiment at a velocity of between 5 to 15 m/s, upwards though the air wash column 76 in the opposite direction to the flow of material 1 into the turbo chamber 75. The geometry of the turbo chamber 75, the flow of air current into the turbo chamber and the falling of the material is designed to create a vortex of material 3 to spin in the turbo chamber 75. This centrifuges out the denser material and agglomerated product 5 and to accelerates the air allowing the lighter separated materials 7 to pass out with the air stream through an acceleration chamber 84, at a speed of approximately 20 m/s, and then via a bend into transfer duct 86. Meanwhile the denser material and agglomerated product 5 falls under gravity into the air wash column 76 which is held under vacuum and causes the remaining lighter product 9 to decelerate, turn through 180° to be washed out of the product steam and entrained into the air stream 78 and then carried back up the air wash column 76 and out through acceleration chamber 84. The denser components of the waste 5 continue to fall down the air wash column 76 and from there are discharged through rotary valve 16 into receiving bay 14. The rotary valves 16 and 10 enable the separator to operate under vacuum.

The degree of separation is controlled by adjusting the geometry of the air wash column 76 to increase or decrease the width and angles within by means of adjuster 87, 89 and/or adjusting the velocity of the airflow 78, 78[1] and/or the geometry of the turbo chamber 75.

Figure 3:
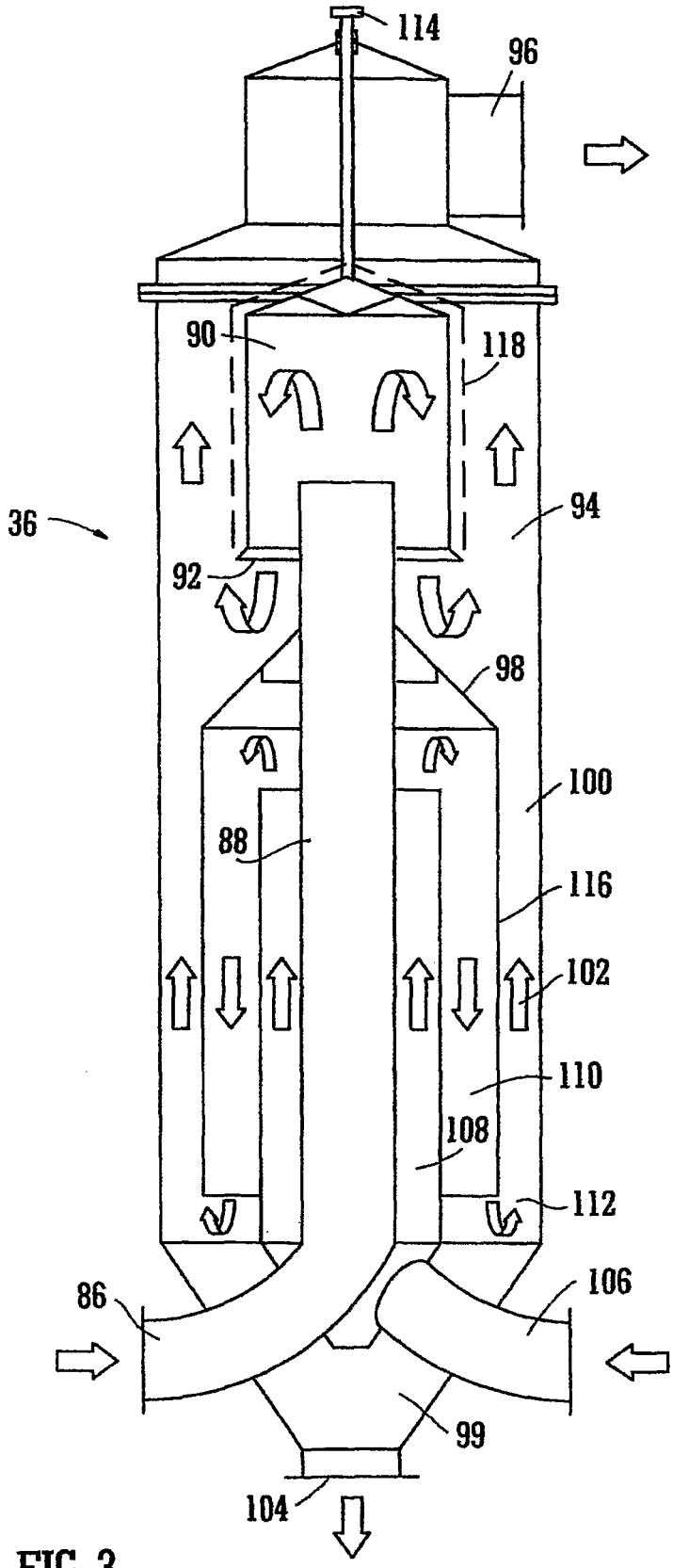
FIG. 3 is a sectional view of the positive pressure density separator of FIG. 1.

In the positive density separator 36, as best illustrated in FIG. 3, the mixed biomass material entering from the transfer cyclone 20 travels from transfer duct 86 at a predetermined velocity into a vertical duct 88 and then passes into an adjustable distribution chamber 90. The distribution chamber 90 is designed to distribute and separate the products of the mixed biomass material within the conveying air stream. The separating biomass material then passes through an adjustable annulus 92, where an initial separation takes place, in that the lighter components of the biomass material turn through 180° and carry on up through a second annulus 94 and out through spigot 96. The lighter components of the biomass waste are thus conveyed upwards by secondary air 102 blown up the separator 36. The heavier components slide down cone 98 and fall into a second separation chamber 100. As the heavier components fall down through the second separation chamber 100, the secondary air 102 is blown in the opposite direction up the chamber 100 in order to separate out any lighter components which could not turn through 180° at the adjustable annulus 92. The thus separated lighter components join the previously separated lighter components and exit at spigot 96. The remaining heavier components carry on down the chamber 100 and are evacuated via a rotary valve from the base 104 of the conical hopper 99.

The secondary air 102 is provided via fan 42 and is fed into the system at 106 and is then fed through a series of chambers 108, 110 to arrive at the base of the second separation chamber 100 at point 112 and at a predetermined velocity.

The size of the annulus 92 is adjusted by lifting or lowering the distribution chamber 90 by use of a screw 114. The geometry of the annulus 94 can be adjusted by replacing distribution chamber 90 by a larger or smaller unit 118 (shown in dotted lines). The size of the chamber 100 can be adjusted by replacing inner sleeve 116 with a smaller or larger unit.

In separator 36 the lighter, plastics leaving the spigot 96 are conveyed into the cyclone separator 44.

A chemical burn analysis of the final high quality biomass fuel product, this being a mixture of end fuel products obtained from the process of embodiments 1 and 2 described above, when compared to the mixed biomass product at the start of the process is shown in table 1. From which it is apparent that contaminants and potentially noxious components have been considerably reduced, whilst yielding a product with a good calorific value.

TABLE 1

| | Units | Biomass Material Before Processing | Biomass Fuel Product After Processing | Comments |
|---|---|---|---|---|
| Total Moisture | % | 15-20 | 12-17 | Reduced |
| Ash | % | 15-20 | 10-16 | Reduced |
| Volatile Matter | % | — | 60-65 | — |
| Sulphur | % | 1.0-0.6 | 0.4-0.8 | Reduced |
| Chlorine | % | 0.4-0.6 | 0.1-0.3 | Reduced |
| Gross Calorific Value | Kj/Kg | 13-18 | 13-16 | Decreased* |
| Net Calorific Value | Kj/Kg | 12-16 | 12-14 | Decreased* |
| Energy Density | $Gj/M^3$ | — | 3-4 | — |
| Arsenic | Mg/Kg Dry | 3-10 | 3-5 | Reduced |
| Antimony | Mg/Kg Dry | 3-10 | 3-10 | — |
| Cadmium | Mg/Kg Dry | 0.4-1 | 0.2-0.5 | Reduced |
| Chromium | Mg/Kg Dry | 15-30 | 10-20 | Reduced |
| Copper | Mg/Kg Dry | 25-65 | 25-35 | Reduced |
| Lead | Mg/Kg Dry | 50-150 | 50-100 | Reduced |
| Mercury | Mg/Kg Dry | <1 | 0.05-0.2 | Reduced |
| Nickel | Mg/Kg Dry | 12-25 | 10-15 | Reduced |
| Vanadium | Mg/Kg Dry | 25-50 | 20-30 | Reduced |
| Zinc | | 50-120 | 50-120 | — |

The calorific value is slightly reduced due to the removal of plastics, plastics having a high calorific value. The reduction in plastics contaminants leads to a significant reduction in environmental pollutants such as for example chlorine.

The resultant high quality biomass fuel product is additionally environmentally friendly when compared with a fossil fuel such as coal and compares with the environmental agency limits set for power stations to obtain government renewable obligations certificates (ROCS) for burning biomass fuels. The results of the test conducted are shown in table 2.

TABLE 2

| Parameter | Units | Environmental Agency Biomass Limits ROCS | Biomass Fuel Product After Processing | Coal Typical |
|---|---|---|---|---|
| Total Moisture | % | 25 | 12-17 | 6-8 |
| Ash | % | 10 | 10-16 | 5-12 |
| Volatile Matter | % | — | 60-65 | 26-37 |
| Sulphur | % | 0.4 | 0.4-0.8 | 0.8-3 |
| Chlorine | % | 0.4 | 0.1-0.3 | 0.1-0.4 |
| Gross Calorific Value | Kj/Kg | — | 13-16 | — |
| Net Calorific Value | Kj/Kg | >14 | 12-14 | 23-31 |
| Energy Density | $Gj/M^3$ | — | 3-4 | 24 |
| Arsenic | Mg/Kg Dry | 5 | 2-5 | Not available |
| Antimony | Mg/Kg Dry | — | 3-10 | Not available |

TABLE 2-continued

| Parameter | Units | Environmental Agency Biomass Limits ROCS | Biomass Fuel Product After Processing | Coal Typical |
|---|---|---|---|---|
| Cadmium | Mg/Kg Dry | 0.2 | 0.2-0.5 | Not available |
| Chromium | Mg/Kg Dry | 30 | 10-20 | Not available |
| Copper | Mg/Kg Dry | 50 | 25-35 | Not available |
| Lead | Mg/Kg Dry | 20 | 50-100 | Not available |
| Mercury | Mg/Kg Dry | 0.05 | 0.05-0.2 | Not available |
| Nickel | Mg/Kg Dry | 30 | 10-15 | Not available |
| Vanadium | Mg/Kg Dry | 20 | 20-30 | Not available |
| Zinc | Mg/Kg Dry | 80 | 50-120 | Not available |

As an alternative a lower range of quality fuel products can be produced by adjusting the controls in the density apparatus 36. Such fuel products collected are suitable for use in gassifiers, cement and paper industries, low grade biomass fuel product for coal fired power stations, local community and industrial heating schemes, and for blending to produce other fuels such as a household fuel.

The various stages of separation each result in a different waste product. The glass and rubble, the non-combustible material and plastics collected in a respective receiving bay can each be further separated for recovery and recycling of the various components therein.

Although the starting material has been described as having no component part greater than 50 mm, the starting material could have components of different maximum dimensions. The mixed biomass material could be passed over a trommel screen to pre-select the maximum dimension of the components parts.

Although the starting point of mixed biomass waste has been described as being produced by the method of treatment of MSW described in WO 03/092922, it is to be understood that the present process could be applied to other types of biomass waste. Furthermore one or more of the various stages could be omitted from the present process to achieve a lower grade biomass fuel.

Although the process has been described as separating out plastics into receiving bay 40 using the positive density separator 36, the process could be adapted to further separate the plastics whereby adjusting the temperature and airflow within the separator recyclable plastics such as P.E.T. could be separated from the less reusable plastics such as P.V.C. At selected temperature the P.E.T. melts into and collates into a more coherent mass which can be blown into a separate receiving bay. Recyclable plastics thus separated provide a reusable bi-product and further reduce the amount of material destined for disposal by landfill While the invention has been described in detail in terms of specific embodiments thereof, it will be apparent that various changes and modifications can be made therein by one skilled in the art without departing from the scope thereof.

What is claimed is:

1. A process for the treatment of municipal solid waste (MSW) derived biomass material to reduce the level of contaminants therein, comprising the steps of:

delivering a stream of mixed, MSW derived biomass material to a first inlet of a vacuum turbo separator operating under negative pressure;

enabling said delivered biomass material to fall from said first inlet through a turbo chamber to a first outlet of the separator;

inducing a sole air stream to flow from a second inlet of the separator through the turbo chamber to a second outlet of the separator and accelerating said air stream at said turbo chamber;

directing said air stream through said falling material in the turbo chamber to entrain said material therein and inducing a vortex of spinning biomass material within the turbo chamber to separate out by centrifugal action denser components of the biomass material;

collecting said denser components of the biomass material by said denser components falling in said first outlet to a receiving bay;

redirecting lighter remaining entrained biomass material to said second outlet in said air stream; and washing said denser components of the biomass material with said air stream downstream of said vortex to separate out lighter components of the biomass material therein, thereby redirecting said separated out lighter components to said second outlet via the air stream.

2. A process as claimed in claim 1, wherein the air stream is induced at a velocity lower than that existing at said turbo chamber.

3. A process as claimed in claim 1, wherein said step of inducing an air stream includes drawing air through the separator and said step of directing includes directing the air stream in substantially the opposite direction to the falling material.

4. A process as claimed in claim 1, further comprising the step of adjusting the flow of the falling biomass material to select the density of components separated from the biomass material.

5. A process as claimed in claim 1, further comprising the step of conveying the redirected biomass material into a positive pressure density separator, directing a further air stream through the re-directed biomass material in the density separator to entrain selected lighter components therein and to move such lighter components to a first outlet of the density separator, and collecting the remaining biomass material and sending it to a second outlet of the density separator for collection in a receiving bay.

6. A process as claimed in claim 5, wherein the further air stream is directed obliquely at said redirected biomass material, and the step of conveying is by a positive pressure air conveying stream.

7. A process as claimed in claim 6, further comprising the step of distributing and separating components of the biomass material within the air conveying stream.

8. A process as claimed in claim 5, wherein the biomass material is further separated into components parts within the density separator by adjusting the airflow.

9. A process as claimed in claim 1, further including the step of separating dust from the separated out lighter components in a cyclone separator.

10. A process as claimed in claim 9, further comprising the step of directing said separated dust to a dust filter.

11. A process as claimed in claim 9, further comprising the step of directing said separated out lighter components from the cyclone to one or more apparatus selected from the group consisting of a receiving bay and a positive pressure density separator.

12. A process as claimed in claim 1, wherein before the step of delivering the mixed, MSW derived biomass material it is sieved to remove components therein having a dimension greater than 3 millimeters.

13. An apparatus for the treatment of municipal solid waste (MSW) derived biomass material to reduce the level of contaminants therein, comprising:

a vacuum turbo separator having at least one inlet and two outlets, said inlet being adapted to admit a stream of mixed, MSW derived biomass material, at least one material duct enabling said biomass material to fall as a curtain of material from said inlet to a first of the two outlets for collection in a receiving bay, a turbo chamber in said material duct, means to supply a sole current of air and to direct it through the falling curtain of biomass material in the turbo chamber such that selected lighter components of the biomass material in the air current are redirected to the second of said two outlets, and means to maintain said material duct under negative pressure, including an air lock at said first of said two outlets, and an induction means that draws said sole current of air from a location down to said air lock and upwards through the vacuum turbo separator, wherein said means to supply a sole current of air directs air at least partially through said material duct downstream of said turbo chamber.

14. An apparatus as claimed in claim 13, comprising means to adjust the geometry of at least one component selected from the group consisting of the material duct, the turbo chamber, and an exit from the turbo chamber for said redirected lighter components to the second outlet.

15. An apparatus as claimed in claim 13, further comprising a positive pressure density separator having at least one inlet and two outlets, the inlet being adapted to admit a stream of mixed, MSW derived biomass material, at least one duct to direct the biomass material through a first of the outlets, and means to supply a current of air and direct it through the stream of biomass material to separate out selected lighter components therein and to direct such to a second of the outlets.

16. An apparatus as claimed in claim 15, wherein the positive pressure density separator has a second inlet for admitting said current of air, and at least one air duct for directing the current of air obliquely at the stream of mixed, MSW derived biomass material.

17. An apparatus as claimed in claim 15, comprising a positive pressure air conveying system to direct the biomass material through the density separator and the density separator comprising at least one adjustable channel to respectively change the direction of flow of said separated out lighter components in the biomass material stream.

18. An apparatus as claimed in claim 17, wherein the density separator comprises means for directing the airflow at the stream of mixed MSW derived biomass material as it changes direction.

19. An apparatus as claimed in claim 17, wherein the density separator comprises a distribution chamber upstream of the adjustable channel.

20. An apparatus as claimed in claim 17, wherein the density separator comprises means to direct the airflow through the remaining system of biomass material downstream of said adjustable channel.

21. An apparatus as claimed in claim 15, wherein said density separator is provided downstream of said second outlet of said turbo separator.

22. An apparatus as claimed in claim 15, comprising at least one fan for providing a positive pressure conveying system for transferring mixed MSW biomass material through the positive pressure density separator.

23. An apparatus as claimed in claim 15, comprising at least one cyclone having an air inlet connected to the second outlet of the vacuum separator or density separator and at least two cyclone outlets, a first of which cyclone outlets being connected to an inlet of a dust filter, the second of which cyclone outlets being connected to at least one apparatus selected from the group consisting of the positive pressure density separator and a collection bay.

* * * * *